US006321045B1

(12) United States Patent
Budnik et al.

(10) Patent No.: US 6,321,045 B1
(45) Date of Patent: Nov. 20, 2001

(54) XEROGRAPHIC DEVELOPMENT SYSTEM, A METHOD FOR PREDICTING CHANGES IN THE RATIO OF TONER TO CARRIER

(75) Inventors: Roger W. Budnik, Rochester; James M. Pacer, Webster; Scott L. Kauffman; Richard M. Maier, both of Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/669,108

(22) Filed: Sep. 25, 2000

(51) Int. Cl.[7] ..... G03G 15/08; G03G 15/00
(52) U.S. Cl. ..... 399/58; 399/59
(58) Field of Search ..... 399/42, 58, 57, 399/60, 61, 62, 49

(56) References Cited

U.S. PATENT DOCUMENTS 4,614,165 9/1986 Folkins et al. ..... 118/657
5,390,004 2/1995 Hopkins ..... 355/208
5,402,214 3/1995 Henderson ..... 355/246
5,839,022 * 11/1998 Wang et al. ..... 399/62
6,035,152 3/2000 Craig et al. ..... 399/49

FOREIGN PATENT DOCUMENTS 63-235972 * 9/1988 (JP) .

* cited by examiner

*Primary Examiner*—Joan Pendegrass
(74) *Attorney, Agent, or Firm*—R. Hutter

(57) ABSTRACT

In a control system for xerographic development, an important value to be monitored in real time is the ratio of toner to carrier (T/C) in the developer supply. However, direct measurements of T/C, whether by magnetometer readings of the developer, or densitometer readings of developed test patches, tend to be noisy. To exclude unusual T/C measurements, after every T/C reading, a likely range of change in T/C is calculated. If a subsequent T/C reading is not within this likely range, the reading is substituted with an upper or lower boundary of the calculated likely range.

9 Claims, 2 Drawing Sheets

XEROGRAPHIC DEVELOPMENT SYSTEM, A METHOD FOR PREDICTING CHANGES IN THE RATIO OF TONER TO CARRIER

CROSS-REFERENCE TO RELATED APPLICATION

Cross-reference is hereby made to a related application, Ser. No. 09/669,198, entitled IN A XEROGRAPHIC DEVELOPMENT SYSTEM, METHOD FOR DETERMINING WHEN THE DEVELOPER MATERIAL SUPPLY SHOULD BE REPLENISHED, and being filed simultaneously herewith.

FIELD OF THE INVENTION

The present invention relates to a system for controlling the concentration of toner within the developer mixture in a xerographic printer.

BACKGROUND OF THE INVENTION

In the well-known process of electrostatographic printing, also known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finally divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper, and the image affixed thereto to form a permanent record of the image to be reproduced.

The step in the electrophotographic process in which the toner is applied to the latent image is known as "development." In any development system, a quantity of toner is brought generally into contact with the latent image, so that the toner particles will adhere or not adhere to various areas on the surface in conformity with the latent image. Many techniques for carrying out this development are known in the art. A number of such techniques require that the toner particles be evenly mixed with a quantity of "carrier." Generally speaking, toner plus carrier equals "developer." Typically, toner particles are extremely fine, and responsive to electric fields; carrier particles are relatively large and respond to magnetic fields. In a "magnetic brush" development system, the developer is exposed to relatively strong magnetic fields, causing the carrier particles to form brush-like strands, much in the manner of iron filings when exposed to a magnetic field. The toner particles, in turn, are triboelectrically adhered to the carrier particles in the strands. What is thus formed is a brush of magnetic particles with toner particles adhering to the strands of the brush. This brush can be brought in contact with the latent image, and under certain conditions the toner particles will separate from the carrier particles and adhere as necessary to the photoreceptor.

An important process parameter for any development system is the ratio of toner particles to carrier within the developer. It is also expectable that, in the course of use of the printer, the toner to carrier ratio (T/C) will change significantly as toner particles are transferred from the developer supply to the photoreceptor and ultimately to print sheets. There have thus been numerous systems devised in the prior art for determining and controlling this T/C in an operating machine. Because carrier particles are generally heavy and magnetic, while toner particles are generally light and non-magnetic, many of these systems involve detecting the behavior of magnetic flux through the developer; placing a quantity of developer between capacitor plates and examining the electrical behavior thereof; or electrically drawing a quantity of toner from the developer and inferring a T/C therefrom. However, very often such systems have proven to be either inaccurate, imprecise, or too expensive for use in inexpensive printers and copiers.

The present invention is directed to a highly precise system for monitoring and controlling the T/C in a developer supply.

DESCRIPTION OF THE PRIOR ART

U.S. Pat. No. 4,614,165 discloses the general concept of using a secondary developer supply for gradually admixing fresh developer into a primary developer supply, thereby retaining a reasonably constant T/C in the primary developer supply.

U.S. Pat. No. 5,390,004 discloses a control system for a xerographic printing system in which the reflectivity of a set of test patches is measured, and the reflectivities are fed into a fuzzy-logic control system for the xerographic parameters.

U.S. Pat. No. 5,402,214 discloses a control system for a xerographic printing system in which the reflectivity of a test patch is measured, and the DC bias of a field associated with the development unit is adjusted accordingly. When the DC bias is caused to exceed a predetermined maximum, fresh developer is added to the primary developer supply.

U.S. Pat. No. 6,035,152 discloses a control system for a xerographic printing system in which the reflectivity of a set of test patches is measured, and the reflectivities are fed into a control system for the xerographic parameters.

SUMMARY OF THE INVENTION

According to one aspect of the present invention, there is provided a control method for an electrostatographic printing system in which there is provided a primary supply of developer material, the developer material comprising toner and carrier and having a toner to carrier ratio (T/C) associated therewith, wherein the developer material in the primary supply is used for developing electrostatic latent images on a charge receptor. A range of likely change of T/C for a predetermined number of prints made with the system, the range including at least one limit value of T/C is calculated according to an algorithm, the algorithm including as an input at least one of a limit rate of dispense of new developer into the primary supply and an assumed mass per unit area developed by the system. After outputting the predetermined number of prints, the T/C in the primary supply is once again measured. If the measured T/C is outside the calculated range, a substitute value is used for the measured T/C in a subsequent calculation relating to T/C.

DETAILED DESCRIPTION OF THE INVENTION

Figure 1:
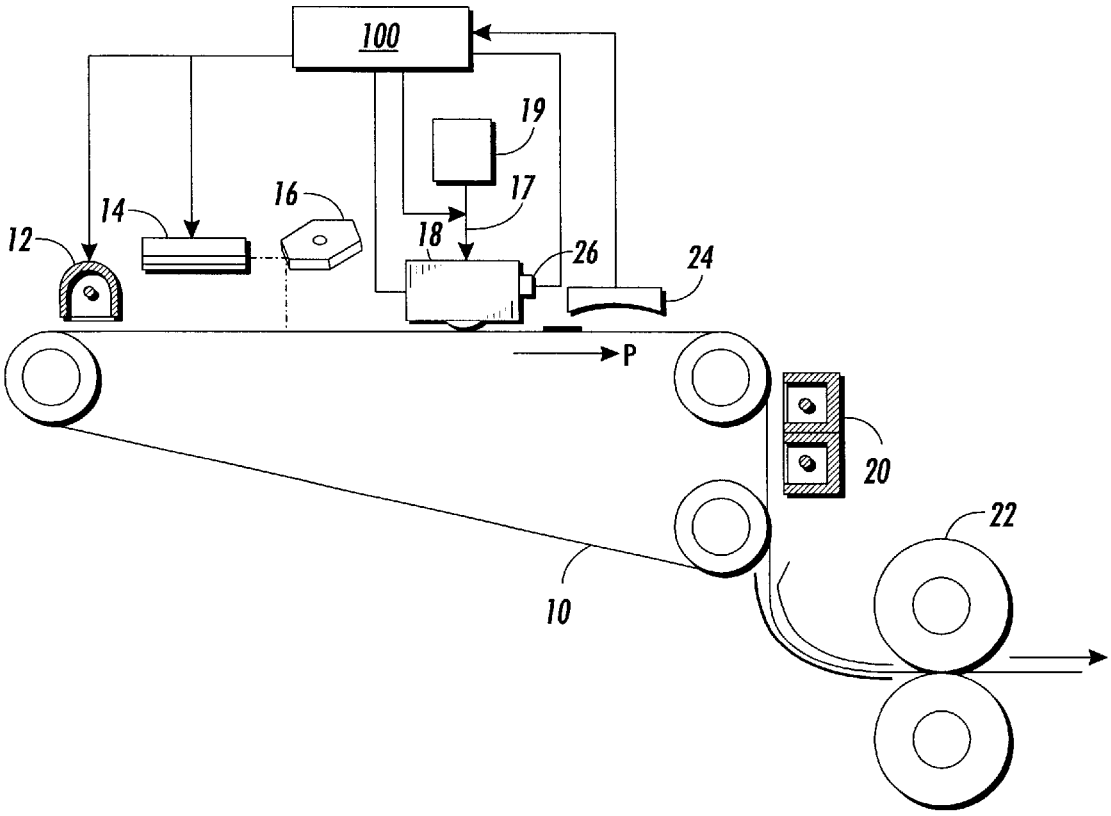
FIG. 1 is an elevational view showing the elements of a xerographic printer relevant to the present invention.

FIG. 1 shows the basic elements of the well-known system by which an electrophotographic printer, such as a copier or a "laser printer," creates a dry-toner image on plain paper. There is provided in the printer a photoreceptor 10, which may be in the form of a belt or drum, and which comprises a charge-retentive surface. The photoreceptor 10 is here entrained on a set of rollers and caused to move through process direction P. Moving from left to right in FIG. 1, there is illustrated the basic series of steps by which an electrostatic latent image according to a desired image to be printed is created on the photoreceptor 10, how this latent image is subsequently developed with dry toner, and how the developed image is transferred to a sheet of plain paper. The first step in the electrophotographic process is the general charging of the relevant photoreceptor surface. As seen at the far left of FIG. 1, this initial charging is performed by a charge source known as a "corotron," indicated as 12. The corotron 12 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the charged photoreceptor 10. Although the Figure shows a laser source to selectively discharge the charge-retentive surface, other apparatus that can be used for this purpose include an LED bar, or, in a copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10.

After certain areas of the photoreceptor 10 are discharged by the laser source 14, the remaining charged areas are developed by a developer unit such as 18 causing a supply of dry toner to contact the surface of photoreceptor 10. The developed image is then advanced, by the motion of photoreceptor 10, to a transfer station including a transfer corotron such as 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Some of the system elements of the printer shown in FIG. 1 are controlled by a control system 100, the operation of which will be described in detail below.

Densitometer 24 is disposed along the path of photoreceptor 10 so as to detect the actual toner density of a test patch, which is intended to have a target density of toner on the photoreceptor. Systems for measuring the true optical density of a test patch are shown in, for example, U.S. Pat. Nos. 4,989,985 or 5,204,538. According to a preferred embodiment of the present invention, the main inputs to control system 100 is a set of ongoing test patch readings from densitometer 24; alternately or in addition, there may be provided a T/C sensor, in the form a magnetometer 26 associated with development unit 18, which can measure the T/C of developer in the unit, in a manner generally known in the art.

According to various embodiments of the present invention, the most important outputs of the control system 100 are either the various DC or AC biases associated with the various actuators in the system, such as corotron 12, laser source 14, or development unit 18, and/or the behavior of what is here generally called a "gate" 17. The gate 17 acts as a selectably openable connection between the development unit 18, which can be considered in the "primary developer supply," and the hopper 19, which can be considered the "secondary developer supply." The primary developer supply is a quantity of developer which is immediately usable for placing toner on photoreceptor 10; as such, it is expected that quantities of toner will be constantly removed from the primary developer supply, thus altering the T/C of the primary toner supply from its optimal level. When gate 17 is opened, fresh developer from hopper 19, which is the secondary developer supply, will replenish the primary developer supply, both refilling the developer unit 18 and (because the secondary developer supply is relatively rich in toner) bringing the T/C in developer unit 18 closer to an optimal level. (It is conceivable, according to a particular design, that the secondary developer supply could contain pure toner, with no carrier at all.)

With any set if inputs or outputs in a system for controlling T/C in a development unit, an important practical limitation is the inherent noisiness of data input to a control algorithm. Whether the input is from a magnetometer directly reading the T/C of developer within the development unit, or based on densitometer readings of test patches, the incoming data will be subject to noise which can cause the individual readings over time to be beyond ranges which are physically possible or likely. The impact of too many unusual readings is that the overall control system can become useless.

The present invention is a system by which a series of incoming T/C determinations, whether based on a direct magnetometer readings or test patch readings, are constrained by a range of minimum and maximum values, which are calculated given presumed inaccuracies in the inputs and outputs of the system. When a particular reading of T/C it is found to be beyond this reasonable range, the questionable reading is substituted with, as needed, either the minimum or maximum value in the reasonable range (or, conceivably, some other substitute value, determined in some other way, such as a predetermined constant). In this way, a series of unlikely T/C determinations are prevented from causing "runaway" results which would impact the overall control system. This general principle of constraining the incoming T/C readings can be applied to any control system for the xerographic printing, regardless of the particular outputs of the control system, such as controlling the bias on different elements in the system, or controlling the dispense of fresh developer into the development unit.

Figure 2:
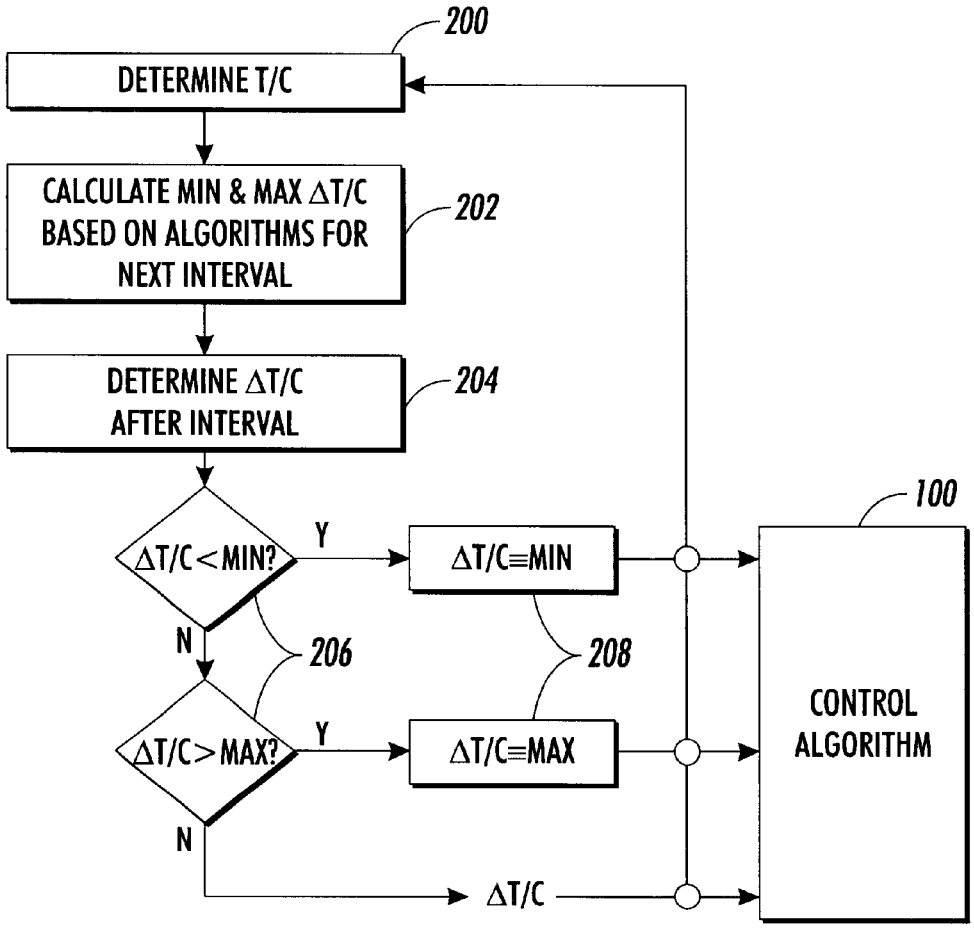
FIG. 2 is a flowchart showing the operation of a control system according to the present invention.

FIG. 2 is a flowchart showing the principle of constraining the incoming readings or determinations of T/C into a reasonable range, and then it using the bees a constrained values for T/C in both the control system which regulates the xerographic system as a whole, and also the subsequent calculations of changes in T/C, as shown at step 200, at some point in the operation of the system, such as every interval of a certain number of output prints, the value of TIC is determined either by a reading by magnetometer 26 or inferred by densitometer readings from one or more test patches, as mentioned above, these incoming values of T/C can individually be quite noisy, and any single reading could disrupt the proper operation of a control system. Thus, at step 202, limit values (such as a minimum and a maximum) of a change in T/C are calculated, based on reasonably assumed variations in the behavior of, for instance, the development unit 18, specific version of such an algorithm will be given in detail below, but in general the output of the algorithm in step 202 is a both a minimum and maximum reasonable value of the possible change in T/C after some interval (typically meaning a number of prints to be output in the future, such as 150 prints).

FIG. 2 is a flowchart showing the principle of constraining the incoming readings or determinations of T/C into a reasonable range, and then it using the constrained values for T/C in both the control system which regulates the xerographic system as a whole, and also the subsequent calculations of changes in T/C. As shown at step 200, at some point in the operation of the system, such as every interval of a certain number of output prints, the value of T/C is determined either by a reading by magnetometer 26 or inferred by densitometer readings from one or more test patches. As mentioned above, these incoming values of T/C can individually be quite noisy, and any single reading could disrupt the proper operation of a control system. Thus, at step 202, limit values (such as a minimum and a maximum) of a change in T/C are calculated, based on reasonably assumed variations in the behavior of, for instance, the development unit 18. Specific versions of such an algorithm will be given in detail below, but in general the output of the algorithm in step 202 is both a minimum and maximum reasonable value of the possible change in T/C after some interval (typically meaning a number of prints to be output in the future, such as 150 prints).

After this interval, meaning after the printing apparatus has output the requisite number of prints, the T/C is once again determined, either by a direct magnetometer reading or test patch results, as shown at step 204. This postinterval determination of T/C is then compared to the calculated at minimum and maximum changes in T/C, as shown at 206. If the post interval change in T/C it is within the reasonable range between the minimum and maximum, this new reading of T/C is considered acceptable for both the relevant algorithm within control system 100, which directly controls the parameters of the xerographic system, and is further re-fed, as shown, back into the flowchart as the latest T/C determination. In short, if the latest determination of T/C is within an acceptable range, it is considered a "good" determination.

If, however, the change in T/C is less than the minimum calculated likely change in T/C, or more than the maximum calculated likely to change in T/C, then the change in T/C is considered suspect. In such a case, as shown at 208, a too-low change in T/C is simply substituted with the calculated minimum change in T/C; and a too-great change in T/C is substituted with the calculated maximum change in T/C. These substituted values are used in both the relevant algorithm in control system 100 and also fed back as a new value of T/C from which the next change in T/C will be determined.

The following is a description of a preferred algorithm, such as used in step 202, for determining a range (bounded by a minimum limit value and a maximum limit value) for acceptable readings of T/C. Once again, the technique of the present invention can be used in conjunction with any control system for electrostatographic printing in which the T/C is a relevant parameter; however, this particular algorithm described below is most relevant to the general system described relative to FIG. 1 above.

First, any change in T/C (Δtc) can be summarized as a function of the dispense rate of new developer from hopper 19 into the primary developer supply 18 (which generally tends to increase T/C), and also the developed mass per unit area (DMA), meaning the mass of toner placed on the photoreceptor or other charge receptor per unit area in a "black" portion of a printed image (a higher DMA meaning more toner is being spent by the system, thus decreasing T/C in the system). In summary:

$$\Delta 66\ tc \sim f(\text{dispense rate, DMA})$$

tc loss→slow dispense, high DMA.

tc gain→fast dispense, low DMA.

It can then be assumed that dispense rate and DMA in a known design of a printing apparatus can be reasonably defined by percentage variations:

Assume:

Dispense Rate Variation=+/−20% (these are the "limit rates")

DMA Variation=+/−10% (these are the "limit masses")

Sump Mass =850 g.

TonerGrams/Pixel=0.000000016

Given this presumed variation in dispense rate and DMA, the limit values (maximum and minimum) for reasonable changes in T/C can be calculated as follows for a known apparatus design:

$\Delta tc$ for one print at a given area coverage:

MinTc=−((nomToner−nomtoner*minRate)+(nomToner*maxDMA−nomToner))/sumpMass*100

MaxTc=((nomToner*maxRate−nomToner)+(nomToner−nomToner*minDMA))/sumpMass*p100

Where: nomToner=tonerGramsPerPixel*pixels pixels=area Coverage*336600

In a practical embodiment of the present invention, a theoretical linear relationship between T/C and area coverage (%AC) called tcSlope is derived from f(%AC, MinTc) and f(%AC, MaxTc) so that tcSlope=%tc/%Ac. The actual T/C reading is inferred from a non-linear relationship called drrSlope between T/C and the difference in reflectivity between test patches of 12.5% and 50% target halftone screens as read by the densitometer 24 so that drrSlope=drrUnits/%tc. In the below calculations, the area coverage, meaning the proportion of print-black pixels to whole images in the output prints, can be monitored in real time based on image data.

Next:

$$\Delta drr = drr\text{Slope} * tc\text{Slope} *$$

AC

Finally: The min/max movement of the drr patch for %AC & # of prints is:

minDrr=minDrrSlopeVariance*tcSlope*%AC*# of prints in interval maxDrr=maxDrrSlopeVariance*tcSlope*%AC*# of prints in interval where: minDrrSlopeVariance and maxDrrSlopeVariance are empirically derived constants=1.25.

What is claimed is:

1. In an electrostatographic printing system in which there is provided a primary supply of developer material, the developer material comprising toner and carrier and having a toner to carrier ratio (T/C) associated therewith, wherein the developer material in the primary supply of developer material is used for developing electrostatic latent images on a charge receptor, a method of operating the system comprising the steps of:

calculating, according to an algorithm, a range of likely change of T/C for a predetermined number of prints made with the system, the range including at least one limit value of T/C, the algorithm including as an input at least one of a limit rate of dispense of new developer into the primary supply and an assumed limit mass per unit area developed by the system;

outputting the predetermined number of prints;

measuring, after outputting the predetermined number of prints, the T/C in the primary supply;

if the measured T/C is outside the calculated range, substituting a substitute value for the measured T/C in a subsequent calculation relating to T/C; and outputting a print using the substitute value.

2. The method of claim 1, the substitute value being a limit value of the calculated likely change of T/C.

3. The method of claim 1, the algorithm including as inputs both a limit rate of dispense of new developer into the primary supply and an assumed mass per unit area developed by the system.

4. The method of claim 1, the range of likely change of T/C including a maximum limit and a minimum limit.

5. The method of claim 4, the substituting step including if the measured T/C is greater than the maximum limit value, substituting the maximum limit value for the measured T/C.

6. The method of claim 4, the substituting step including if the measured T/C is less than the minimum limit value, substituting the minimum limit value for the measured T/C.

7. The method of claim 1, wherein the electrostatographic printing system includes a secondary supply of developer and a selectably-actuable dispense means for conveying developer from the secondary supply to the primary supply.

8. The method of claim 1, wherein the T/C is measured at least in part by a magnetometer associated with the primary supply.

9. The method of claim 1, wherein the T/C is measured at least in part by a densitometer measuring an actual reflectivity of a test patch developed on the charge receptor.

* * * * *